US006444627B1

(12) United States Patent
Berchtold et al.

(10) Patent No.: US 6,444,627 B1
(45) Date of Patent: Sep. 3, 2002

(54) LUBRICANT COMPOSITION

(75) Inventors: Peter H. Berchtold, Horgen; Irene Siegrist, Staefa, both of (CH)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 09/787,039

(22) PCT Filed: Oct. 20, 1999

(86) PCT No.: PCT/US99/24692

§ 371 (c)(1),
(2), (4) Date: Mar. 13, 2001

(87) PCT Pub. No.: WO00/23648

PCT Pub. Date: Apr. 27, 2000

Related U.S. Application Data

(60) Provisional application No. 60/104,981, filed on Oct. 20, 1998.

(51) Int. Cl.[7] ..... C10M 107/34; D06M 13/165

(52) U.S. Cl. ..... 508/562; 508/487; 508/579; 252/8.81; 252/77

(58) Field of Search ..... 508/562, 579, 508/487

(56) References Cited

U.S. PATENT DOCUMENTS

| | | | | | |
|---|---|---|---|---|---|
| 3,140,198 | A | | 7/1964 | Dawson et al. | 117/138.8 |
| 3,464,925 | A | * | 9/1969 | Benoit et al. | 252/77 |
| 4,409,187 | A | | 10/1983 | Köhler et al. | 508/543 |
| 4,828,735 | A | | 5/1989 | Minagawa et al. | |
| 5,143,640 | A | * | 9/1992 | Moxey | 508/579 |
| 5,194,208 | A | * | 3/1993 | Monthey et al. | 264/130 |
| 5,254,277 | A | * | 10/1993 | Gentit et al. | 508/562 |
| 5,334,322 | A | * | 8/1994 | Williams, Jr. | 508/579 |
| 5,652,204 | A | * | 7/1997 | Cracknell et al. | 508/562 |
| 6,133,211 | A | * | 10/2000 | Cobianco et al. | 508/579 |

FOREIGN PATENT DOCUMENTS

| | | |
|---|---|---|
| DE | 20 22 484 | 12/1970 |
| EP | 0 336 310 | 10/1989 |
| EP | 0 415 626 | 3/1991 |
| WO | WO 93/18118 | 9/1993 |

OTHER PUBLICATIONS

Chemical Abstract 100:54321g; JP 58 132 090, Mold releasing agents for molding of rubber. Daiichi Kogyo Seiyaku Co. Ltd., Japan.
Chemical Abstract 100:71063s;JP 58 145 791, Nippon Oils and Fats Co. Ltd; Lubricating oil emulsions.
Chemical Abstract; JP 01163 293–A Nippon Oils and Fats Co. Ltd.

* cited by examiner

*Primary Examiner*—Ellen M. McAvoy

(57) ABSTRACT

A lubricant composition comprises (a) an optionally esterified or etherified reaction product of (i) an alcohol comprising up to 6 hydroxy groups and no heteroatom other than oxygen and (ii) one or more alkylene oxides; and (b) a reaction product of (i) ammonia or an alkanol amine and (ii) one or more alkylene oxides, wherein the average OH-functionality of the reaction products (a) and (b) is up to 4.5 and the total number of units derived from alkylene oxide in the reaction product (b) is up to about 12. The lubricant composition is particularly useful for treating fiber materials.

16 Claims, No Drawings

LUBRICANT COMPOSITION

This application is a 371 of PCT/US98/24692, filed Oct. 20, 1999, which claims benefit of Provisional application Ser. No. 60/104,981 filed Oct. 20, 1998.

The present invention relates to a lubricant composition and to a method of treating fiber materials.

BACKGROUND OF THE INVENTION

Lubricants and lubricant compositions are known for a wide range of applications, for example as hydraulic fluids, metal working fluids, car brake fluids, and treatment of fibers.

From U.S. Pat. No. 4,409,187 a sealing agent and lubricant for medium-pressure and high-pressure autoclaves is known. It is a polyether polyol which has an average OH-functionality of 5.0 to 7.0 and an average OH number of 250 to 500. The polyether polyol is prepared by reacting ethylene oxide and/or propylene oxide with a mixture of sucrose and at least one other starting molecule which is chosen from a) polyhydric alcohols with an OH-functionality of less than 8, b) monoamines or polyamines which contain at least 2 hydrogen atoms bonded to the amino nitrogen, and c) water.

Chemical Abstracts 100:54321 g, abstracting Japanese Kokai 58-132,090, discloses the use of ammonia- or ethanolamine-polyalkylene glycol condensates as mold-releasing agents for molding apparatus for rubber. These condensates can be blended with a conventional release agent, such as a polypropylene glycol, polyoxypropylene glyceryl ether, polyoxyethylene/polyoxypropylene block copolymer, polyoxypropylene/polyoxyethylene glyceryl ether, polyethylene glycol, silicone oil, animal oil, vegetable oil or mineral oil.

U.S. Pat. No. 4,828,735 discloses an aqueous lubricant composition which contains a first polyether component, a second polyether component, a polyamide component, water and optionally a water-soluble polyalkylene glycol. The first polyether component is the reaction product of 2 to 200 units of one or more alkylene oxides with a monohydric alcohol, a phenol or an amine. The second polyether component is the reaction product of one or more alkylene oxides with a polyhydric alcohol, polyhydric phenol or a polyamine having 2 to 26 carbon atoms. The second polyether component contains 2 to 8 chains, each chain containing from 10 to 3,000 alkyleneoxy groups.

Unfortunately, the disclosed lubricant compositions have a relatively high viscosity and a limited usefulness in some commercially important applications.

U.S. Pat. No. 3,140,198 relates to the treatment of textile materials, particularly fibers and filaments. The U.S. patent discloses that anionic, cationic and non-ionic surface-active agents in admixture with water-insoluble oily or waxy lubricants are used to lubricate the fibers and to reduce static electrification. In the case of textile materials made from synthetic fibers with hydrophobic properties, such as polyolefins, polyamides, polyesters and polyacrylonitriles, difficulties are sometimes experienced because of failure of the above-mentioned processing aids to spread uniformly over the fibers or yarns. The U.S. patent suggests the additional use of siloxane oxyalkylene block or graft copolymers to solve this problem.

Lubricants used for fibers, such as industrial or textile fibers, need to have a high lubricity and a low volatility. During the fiber and yarn production, the fibers and lubricant can reach very high temperatures, such as up to 250° C. The fibers are usually drawn or stretched over heated cylinders which have an even higher temperature. Evaporation or degradation of fiber lubricants which come in contact with such cylinders can usually not be entirely prevented. The use of alkoxylated glycols as fiber lubricants is known, however they often have an undesirably high volatility. High-boiling polyol-esters are used to a large extent as fiber lubricants in view of their thermal stability. Unfortunately, they coke on high temperature cylinders and leave a sticky residue. This requires repeated cleaning of cylinders in fiber or yarn producing machines.

In view of the above-mentioned disadvantages of known lubricants with respect to fiber treatment applications especially, it is one object of the present invention to provide a new lubricant which has a low volatility. It is another object of the present invention to provide a new lubricant which does not leave a substantial amount of sticky residues upon evaporation.

SUMMARY OF THE INVENTION

One aspect of the present invention is a lubricant composition which comprises a) an optionally esterified or etherified reaction product of i) an alcohol comprising up to 6 hydroxy groups and no heteroatom other than oxygen and ii) one or more alkylene oxides; and b) a reaction product of i) ammonia or an alkanol amine and ii) one or more alkylene oxides, wherein the average OH-functionality of the reaction products a) and b) is up to about 4.5 and the total number of units derived from alkylene oxide in the reaction product b) is up to about 12.

Another aspect of the present invention is a method of treating a fiber material which comprises the step of applying to the fiber material a lubricant composition comprising a) an optionally esterified or etherified reaction product of i) an alcohol comprising up to 6 hydroxy groups and no heteroatom other than oxygen and ii) one or more alkylene oxides; and b) a reaction product of i) ammonia or an alkanol amine and ii) one or more alkylene oxides.

Yet another aspect of the present invention is the use of a) an optionally esterified or etherified reaction product of i) an alcohol comprising up to 6 hydroxy groups and no heteroatom other than oxygen and ii) one or more alkylene oxides; and b) a reaction product of i) ammonia or an alkanol amine and ii) one or more alkylene oxides for treating fiber materials.

The combination of the reaction products a) and b) as recited above has a low volatility, considering the volatility of the individual components.

DETAILED DESCRIPTION OF THE INVENTION

The lubricant composition of the present invention and the lubricant composition which is used in the method of the present invention preferably comprise from 70 to 99 percent, more preferably from 80 to 97.5 percent, most preferably from 85 to 95 percent of a) an optionally esterified or etherified reaction product of i) an alcohol comprising up to 6 hydroxy groups and no heteroatom other than oxygen and ii) one or more alkylene oxides and from 1 to 30 percent, more preferably from 2.5 to 20 percent, most preferably from 5 to 15 percent of b) a reaction product of i) ammonia or an alkanol amine and ii) one or more alkylene oxides, the percentages being based on the total weight of the reaction products a) and b).

The reaction products a) and b) comprise units derived from one or more alkylene oxides, preferably ethylene oxide, propylene oxide and/or butylene oxide. If the reaction product a) or the reaction product b) comprises units derived from more than one type of alkylene oxides, these units can be arranged in blocks, however they are preferably arranged randomly.

The reaction product a) preferably comprises from 1 to 100, more preferably from 3 to 50, most preferably from 5 to 20 units derived from alkylene oxide.

An alcohol comprising up to 6 hydroxy groups, preferably from 1 to 4 hydroxy groups, and no heteroatom other than oxygen is used as a starting material for producing the reaction product a). Exemplary of such alcohols are polyhydric alcohols, such as mono-, di- or triethylene glycol, mono-, di- or tripropylene glycol, butane diol, hexylene glycol, octylene glycol, glycerin, trimethylolpropane, pentaerythritol, sorbitol, mannitol, glucose or sucrose; partially etherified polyhydric alcohols, such as a methyl, ethyl, n-propyl, isopropyl, n-butyl, isobutyl or tert. butyl ether of mono-, di- or triethylene glycol or a methyl, ethyl, n-propyl, isopropyl, n-butyl, isobutyl or tert. butyl ether of mono-, di- or tripropylene glycol or a fatty alcohol containing from 6 to 20 carbon atoms, preferably from 8 to 18 carbon atoms.

The reaction product a) can comprise up to 6 hydroxy groups or it can be partially or fully esterified or etherified. To achieve esterification or etherification, the reaction product a) comprising up to 6 hydroxy groups can be reacted with known esterification or etherification agents to produce a fully or partially esterified or etherified reaction product. Esterification agents are for example organic acids or acid halides, preferably an aliphatic saturated or unsaturated $C_{1-20}$-monocarboxylic acid, such as acetic acid, hexanoic acid or 2-ethyl-hexanoic acid, or an acid halide thereof. Etherification agents are for example $C_{1-4}$-halides or sulfates, preferably $C_{1-4}$-chlorides, such as methyl chloride or dimethyl sulfate.

The reaction product b) which is used in the method of the present invention generally comprises from 1 to 18, preferably from 1 to 12, more preferably from 1 to 10, most preferably from 1 to 8 units derived from alkylene oxide. The reaction product b) which is comprised in the lubricant composition of the present invention comprises from 1 to 12, preferably from 1 to 10, more preferably from 1 to 8 units derived from alkylene oxide.

Ammonia or an alkanol amine is used as a starting material for producing the reaction product b). Preferred alkanol amines contain from 1 to 3 alkanol groups and from 1 to 6, more preferably from 1 to 3 carbon atoms in each alkanol group. Preferred examples thereof are mono-, di- or trimethanolamine, mono- di- or triethanolamine, mono-, di- or tri-n-propanolamine or mono-, di- or triisopropanolamine. The alkanol amine may contain 1 or 2 alkyl groups, however it must contain at least one alkanol group. The alkyl group(s), if present, preferably contain from 1 to 6 carbon atoms, more preferably from 1 to 4 carbon atoms, such as methyl or ethyl, propyl or butyl. Exemplary of such alkylated alkanolamines are ethyl diethanolamine or butylethanolamine.

The reaction product b) is preferably represented by Formula I, more preferably by Formula II (Formula I)

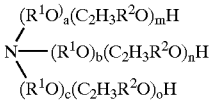

-continued (Formula II)

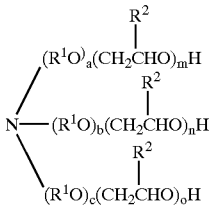

wherein each $R^1$ independently is a hydrocarbon group comprising from 1 to 6, preferably from 1 to 3 carbon atoms, each $R^2$ independently is hydrogen, methyl or ethyl, a, b and c each independently are 0 or 1, and m, n and o each independently are from 0 to 12, preferably from 0 to 6, with the proviso that the sum of m, n and o is from 1 to 12, preferably from 1 to 10, more preferably from 1 to 8.

If the amine is only monosubstituted, that means if two of the sums (a+m) or (b+n) or (c+o) are zero, the amine of formula I and II contains two hydrogens bonded to the nitrogen.

If the amine is only disubstituted, that means if one of the sums (a+m) or (b+n) or (c+o) is zero, the amine of formula I and II contains one hydrogen bonded to the nitrogen.

Preferably, the amine of formula I and II is trisubstituted, that means that none of the sums (a+m) or (b+n) or (c+o) is zero.

In the lubricant composition of the present invention the reaction products a) and b) and their respective amounts are chosen such that the average OH-functionality of the reaction products a) and b) is up to 4.5, preferably up to 4, more preferably up to 3. The average OH-functionality of the reaction products a) and b) is the total moles of hydroxyl groups in the reaction products a) and b) divided by the total moles of reaction products a) and b).

The sum of the above-described reaction products a) and b) generally is from 5 to 99 percent, preferably from 50 to 95 percent, more preferably from 70 to 90 percent, based on the total weight of the lubricant composition. The lubricant composition may additionally contain known additives in known amounts, such as water as a diluent, one or more antioxidants, surfactants, antistatic agents, corrosion inhibitors, antifoam agents, anti-wear and/or known extreme pressure (EP) additives.

The viscosity of the lubricant composition preferably is up to 100 cSt, more preferably from 40 to 60 cSt ($mm^2s^{-1}$) at 20° C.

The lubricant composition has a low volatility, considering the volatilities of the individual reaction products. It has been observed, in this regard, that even the inclusion of a relatively low amount of reaction product b), such as from 1 to 30 percent, preferably from 2.5 to 20 percent, more preferably from 5 to 15 percent, based on the total weight of a) and b), reduces the volatility of the combination of the reaction products a) and b) drastically, as compared to the volatility of the reaction product a) alone. In contrast, this effect has not been observed to any comparable degree when the reaction product a) is combined with a reaction product c) of a polyamine, such as ethylene diamine or triethylenetetraamine, with one or more alkylene oxides.

The lubricant composition of the present invention is useful for several applications, for example as a spin finish or as a process oil, such as an air compressor lubricant, as a lubricant for compressor heat-pumps, as a refrigerator plant compressor lubricant or as a metal working fluid. In view of its low volatility, the lubricant composition of the present invention is particularly useful for applications wherein the lubricant reaches a temperature of from 120° C. to 300° C., preferably from 150° C. to 280° C., more preferably from 200° C. to 250° C. At a temperature above about 300° C., the combination of the reaction products a) and b) generally evaporates to a substantial extent without leaving a significant amount of a sticky residue. This is very advantageous because the reaction products a) and b) do not leave significant residues on high temperature parts of equipment or machines, such as cylinders in fiber or yarn producing machines, or after lubricant spills on the surface of short heaters during a texturing step. As another example, less decomposition of lubricant and deposit formation occurs at high surface temperature at the pressure-valves on piston compressors.

One preferred application of the inventive lubricant compositions which takes advantage of these characteristics is in treating a fiber material according to a method which comprises the step of applying to the fiber material a lubricant composition comprising a) an optionally esterified or etherified reaction product of i) an alcohol comprising up to 6 hydroxy groups and no heteroatom other than oxygen and ii) one or more alkylene oxides; and b) a reaction product of i) ammonia or an alkanol amine and ii) one or more alkylene oxides.

The fiber material can be industrial or textile fibers. The lubricant composition is particularly useful in the production or processing of synthetic fibers, filaments or yarns, such as polyesters, polyamides or polypropylenes. The lubricant is useful in the production of staple-fiber yarns or continuous filament yarn. It is also useful in the production of fabrics from yarns, such as weaving, knitting or tufting; or in the production of fabrics from fibers, such as the production of felts and nonwovens. The lubricant composition is preferably used in an amount of from 0.05 to 5 percent, more preferably from 0.1 to 3 percent, most preferably from 0.2 to 2 percent, based on the weight of the fiber material.

The invention is illustrated by the following examples which should not be construed to limit the scope of the present invention. Unless stated otherwise all parts and percentages are given by weight.

The materials which are used in the examples are indicated in Table I below.

TABLE I

| | Designation | volatility % |
|---|---|---|
| Reaction product a) initiator/alkylene oxide | | |
| diethylene glycol n-butyl ether/3 PO + 5 EO mixed feed | a)1 | 97 |
| butane diol/1.5 PO + 7 EO mixed feed | a)2 | 80 |
| dipropylene glycol n-butyl ether/62.7% EO + 37.5% PO mixed feed, to mol. wt. 450 | a)3 | 92 |
| dipropylene glycol n-butyl ether/50% EO + 50% PO mixed feed, to mol. wt. 1000 | a)4 | 94 |
| dipropylene glycol n-butyl ether/53% EO + 47% PO mixed feed, to mol. wt. 1300 | a)5 | 89 |
| dipropylene glycol n-butyl ether/75% EO + 25% PO mixed feed, to mol. wt. 3800 | a)6 | 67 |
| mono-propylene glycol/PO, mol. wt. 400 | a)7 | 94 |
| mono-propylene glycol/PO, mol. wt. 1000 | a)8 | 98 |
| propylene glycol n-butyl ether/BO, mol. wt. 1000 | a)9 | 95 |
| $C_8$-tatty alcohol/8 EO, then 2 PO | a)10 | 46 |
| Reaction product b) initiator/alkylene oxide | | |
| triethanolamine/3 PO, then 3 EO | b)1 | 14 |
| diethanolamine/1 PO | b)2 | 40 |
| diisopropanolamine/7 EO | b)3 | 8 |
| monoisopropanolamine/8 EO | b)4 | 8 |
| Reaction product c) (comparative) initiator/alkylene oxide | | |
| ethylene diamine/50% EO + 50% PO mixed feed, to mol. wt. 1900 | c)1 | 24 |
| ethylene diamine/50% EO + 50% PO mixed feed, to mol. wt. 6000 | c)2 | 16 |
| triethylene tetraamine/first PO to mol. wt. 5000, then 10% EO, based on PO | c)3 | 3 |

EO = ethylene oxide, PO = propylene oxide, BO = butylene oxide

EXAMPLES 1–22 AND COMPARATIVE EXAMPLES A to X

Volatility (evaporation) of the lubricant composition of the present invention and of comparative lubricants or lubricant compositions at elevated temperature was measured as follows. Two round glass dishes with exactly 28 mm inside diameter and about 30 mm in height were used. 1.0 g of lubricant (composition) was put in each dish. The weight accuracy was +/−0.0001 g. The dishes were placed in a vented gravity-convection oven wherein a temperature of 220° C.(±2° C.) is maintained for two hours (±2 minutes.). The dishes were removed from the oven, allowed to cool to room temperature (23° C.±3° C.) and weighed. The percentage of fluid evaporated from each dish was calculated. The same lubricant or lubricant composition was measured at least twice.

The results are listed in Table II below.

TABLE II

| (Comp.) Example No. | Reaction product a) (9 wt. parts) | Reaction product b) (1 wt. part) | Reaction product c) (1 wt. part) | measured volatility |
|---|---|---|---|---|
| A | a)1 | — | — | 97 |
| 1 | a)1 | b)1 | — | 7 |
| 2 | a)1 | b)2 | — | 13 |
| 3 | a)1 | b)4 | — | 7 |
| 4 | a)1 | b)3 | — | 12 |
| B | a)1 | — | c)1 | 70 |
| C | a)1 | — | c)2 | 88 |
| D | a)1 | — | c)3 | 57 |
| E | a)2 | — | — | 80 |
| 5 | a)2 | b)1 | — | 5 |
| 6 | a)2 | b)4 | — | 5 |
| F | a)2 | — | c)2 | 32 |
| G | a)2 | — | c)1 | 21 |
| H | a)3 | — | — | 92 |
| 7 | a)3 | b)1 | — | 25 |
| 8 | a)3 | b)4 | — | 28 |
| I | a)3 | — | c)2 | 85 |
| J | a)4 | — | — | 94 |
| 9 | a)4 | b)1 | — | 5 |
| 10 | a)4 | b)4 | — | 8 |
| K | a)4 | — | c)2 | 65 |
| 11 | a)5 | b)1 | — | 5 |
| 12 | a)5 | b)4 | — | 10 |
| M | a)5 | — | c)3 | 53 |
| O | a)6 | — | — | 67 |
| 13 | a)6 | b)1 | — | 7 |
| 14 | a)6 | b)4 | — | 8 |
| P | a)6 | — | c)1 | 52 |
| Q | a)7 | — | — | 94 |
| 15 | a)7 | b)1 | — | 30 |
| 16 | a)7 | b)4 | — | 32 |
| R | a)7 | — | c)1 | 74 |
| S | a)8 | — | — | 98 |
| 17 | a)8 | b)1 | — | 21 |

TABLE II-continued

| (Comp.) Example No. | Reaction product a) (9 wt. parts) | Reaction product b) (1 wt. part) | Reaction product c) (1 wt. part) | measured volatility |
|---|---|---|---|---|
| 18 | a)8 | b)4 | — | 24 |
| T | a)8 | — | c)1 | 65 |
| U | a)9 | — | — | 95 |
| 19 | a)9 | b)1 | — | 16 |
| 20 | a)9 | b)3 | — | 21 |
| V | a)9 | — | c)2 | 83 |
| W | a)10 | — | — | 46 |
| 21 | a)10 | b)1 | — | 6 |
| 22 | a)10 | b)4 | — | 6 |
| X | a)10 | — | c)2 | 42 |

Deposit formation of lubricants at elevated temperatures was measured as follows. One drop of lubricant was placed on a clean, polished stainless-steel plate for 1 minute. In a first trial the stainless-steel plate had a surface temperature of 300° C., in the second trial the plate had a surface temperature of 400° C. The steel plate was then allowed to cool to room temperature (23° C.±3° C.) and the remaining lubricant portion on the steel plate was visually inspected.

The lubricant composition of Example 1 evaporated in the first and second trial to a high extent without leaving a significant amount of residue on the steel plate. The lubricant composition of comparative example B left a sticky residue on the steel plate.

These results were compared with the trimethylol propane ester of a $C_{8-10}$-monocarboxylic acid, which is a known polyol-ester lubricant. It evaporated to a lesser extent than the lubricant composition of Example 1 but left a brownish, sticky residue on the steel plate.

What is claimed is:

1. A lubricant composition comprising a) from 70 to 99 percent of an optionally esterified or etherified reaction product of i) an alcohol comprising up to 6 hydroxy groups and no heteroatom other than oxygen and ii) one or more alkylene oxides of 2 to 4 carbon atoms, the total number of alkylene oxide units being from 3 to 100, which reaction product comprises up to 6 hydroxy groups or is partially or fully esterified with an aliphatic saturated or unsaturated $C_{1-20}$-monocarboxylic acid or an acid halide thereof or is partially or fully etherified with a $C_{1-4}$ halide or sulfate; and b) from 1 to 30 percent of a compound of Formula I (Formula I)

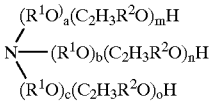

wherein each $R^1$ independently is a hydrocarbon group comprising from 1 to 6 carbon atom, each $R^2$ independently is hydrogen, methyl or ethyl, a, b and c each are 1, and m, n and o each independently are from 0 to 12, with the proviso that the sum of m, n and o is from 1 to 12, the percentages of a) and b) being based on the total weight of a) and b), and wherein the average OH-functionality of the total of the reaction product a) and the compound b) is up to 4.5.

2. The lubricant composition of claim 1, wherein the reaction product a) is a reaction product of i) an alcohol comprising from 1 to 4 hydroxy groups and no heteroatom other than oxygen and ii) one or more alkylene oxides of 2 to 4 carbon atoms.

3. The lubricant composition of claim 1, wherein in formula I m, n and o each independently are from 0 to 6.

4. The lubricant composition of claim 1 comprising from 80 to 97.5 percent of the reaction product a) and from 2.5 to 20 percent of the compound b), based on the total weight of a) and b).

5. The lubricant composition of claim 1, wherein the sum of the reaction product a) and the compound b) is from 50 to 95 percent, based on the total weight of the lubricant composition.

6. The lubricant composition of claim 1 having a viscosity of up to 100 $mm^2s^{-1}$ (cSt) at 20° C.

7. A method of lubricating a fiber material comprising the step of applying to the fiber material the lubricant composition of claim 1.

8. The method of claim 7 wherein the lubricant composition of any one of claims 2, 4, 5, 6 and 7 is applied to the fiber material.

9. The lubricant composition of claim 2, wherein in formula I m, n and o each independently are from 0 to 6.

10. The lubricant composition of claim 9 wherein the reaction product a) comprises from 3 to 50 units derived from one or more alkylene oxides of 2 to 4 carbon atoms.

11. The lubricant composition of claim 3 wherein in formula I the sum of m, n and o is from 1 to 8.

12. The lubricant composition of claim 10 wherein in formula I the sum of m, n and o is from 1 to 8.

13. The lubricant composition of claim 12 comprising from 80 to 97.5 percent of the reaction product a) and from 2.5 to 20 percent of the compound b), based on the total weight of a) and b).

14. The lubricant composition of claim 13 having a viscosity of up to 100 $mm^2s^{-1}$ (cSt) at 20° C.

15. A lubricant composition comprising a) from 80 to 97.5 percent of an optionally esterified or etherified reaction product of i) an alcohol comprising from 1 to 4 hydroxy groups and no heteroatom other than oxygen and ii) one or more alkylene oxides of 2 to 4 carbon atoms, the total number of alkylene oxide units being from 3 to 100, which reaction product comprises up to 4 hydroxy groups or is partially or fully esterified with an aliphatic saturated or unsaturated $C_{1-20}$-mono-carboxylic acid or an acid halide thereof or is partially or fully etherified with a $C_{1-4}$ halide or sulfate; and b) from 1 to 30 percent of a compound of Formula I (Formula I)

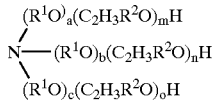

wherein each $R^1$ independently is a hydrocarbon group comprising from 1 to 4 carbon atom, each $R^2$ independently is hydrogen, methyl or ethyl, a, b and c each are 1, and m, n and o each independently are from 0 to 6, with the proviso that the sum of m, n and o is from 1 to 12, the percentages of a) and b) being based on the total weight of a) and b), and wherein the average OH-functionality of the total of the reaction product a) and the compound b) is up to 4.5.

16. A method of lubricating a device selected from the group consisting of air compressors, compressor heat-pumps, refrigerator plant compressors or a metal working devices comprising the step of applying to the device the lubricant composition of claim 1.

* * * * *